US009184532B2

(12) United States Patent
Crovetti et al.

(10) Patent No.: US 9,184,532 B2
(45) Date of Patent: Nov. 10, 2015

(54) SOCKET WITH A COVER LOCK

(71) Applicant: Menber's S.p.A., Legnano (Verona) (IT)

(72) Inventors: Claudio Crovetti, Borgo Virgilio (IT); Tiziano Bianchin, Megliadino San Vitale (IT)

(73) Assignee: Menber's S.p.A., Legnano (Verona) (IT)

( * ) Notice: Subject to any disclaimer, the term of this patent is extended or adjusted under 35 U.S.C. 154(b) by 0 days.

(21) Appl. No.: 14/307,283

(22) Filed: Jun. 17, 2014

(65) Prior Publication Data

US 2014/0377970 A1 Dec. 25, 2014

(30) Foreign Application Priority Data

Jun. 25, 2013 (IT) ..... TO2013A0519

(51) Int. Cl.

| | |
|---|---|
| ***H01R 13/44*** | (2006.01) |
| ***H01R 13/52*** | (2006.01) |
| ***H01R 13/447*** | (2006.01) |
| ***H01R 13/627*** | (2006.01) |
| ***H01R 13/629*** | (2006.01) |
| ***H01R 13/639*** | (2006.01) |

(52) U.S. Cl.

CPC ..... *H01R 13/5213* (2013.01); *H01R 13/447* (2013.01); *H01R 13/6275* (2013.01); *H01R 13/62938* (2013.01); *H01R 13/62955* (2013.01); *H01R 13/639* (2013.01)

(58) Field of Classification Search

CPC ..... H01R 13/447; H01R 13/5213
USPC ..... 439/142
See application file for complete search history.

(56) References Cited

U.S. PATENT DOCUMENTS 1,804,908 A * 5/1931 Wichert ..... 439/142
5,660,295 A * 8/1997 Hroma et al. ..... 220/324

(Continued)

FOREIGN PATENT DOCUMENTS

DE 202009002880 U1 7/2010
EP 1492203 A2 12/2004

OTHER PUBLICATIONS

Italian search report for application No. TO20130519 dated Mar. 6, 2014.

*Primary Examiner* — Tho D Ta
(74) *Attorney, Agent, or Firm* — Patterson & Sheridan, LLP

(57) ABSTRACT

A socket comprising a body having an opening in which a contact-holder is housed, a cover articulated to the body and movable between a closed position in which it closes said opening and an open position in which it is raised from said opening, a yoke articulated to the body and movable between a lowered position and a raised position, the yoke having two arms which, in the lowered position, are intended to cooperate with a shoulder of a plug to retain the plug inserted into the socket, and a latch member articulated to the yoke and movable with respect to the yoke between a locked position and an unlocked position, the latch member having at least one pawl which, in the locked position, engages a corresponding seat of the body and which, in the unlocked position, is disengaged from said seat, and a cover-lock element articulated to the body and movable between an engaged position and a disengaged position, wherein the latch member has at least one cam portion that cooperates with the cover-lock element for moving the cover-lock element from the engaged position to the disengaged position when the latch member moves from the locked position to the unlocked position.

7 Claims, 7 Drawing Sheets

(56) References Cited

U.S. PATENT DOCUMENTS 5,747,739 A * 5/1998 Moeller ..... 439/142
6,827,594 B1 * 12/2004 Davis et al. ..... 439/157
8,888,515 B2 * 11/2014 Hachadorian ..... 439/142
2002/0137376 A1 9/2002 Miyamoto et al.

* cited by examiner

SOCKET WITH A COVER LOCK

CROSS-REFERENCE TO RELATED APPLICATIONS

This application claims benefit of U.S. provisional patent application Ser. No. TO2013A000519, filed Jun. 25, 2013, which is herein incorporated by reference.

BACKGROUND OF THE INVENTION

1. Field of the Invention

The present invention relates to a socket for a connector assembly, particularly intended for the electrical connection between a towing vehicle and a trailer, or between a tractor and an implement.

2. Description of the Related Art

The control devices used on vehicles for towing trailers or on agricultural tractors increasingly require signals that are transmitted by means of a CAN (Controller Area Network) bus between the tractor and a tool or between a towing vehicle and the trailer.

The ISO standard 11783-2 defines the characteristics of the connectors used for the electronic interconnection, e.g. between tractors and implements. The sockets for the electrical connectors, according to the ISO standard 11783-2, must be well sealed to prevent the entry of water, dust, or other contaminants, which could compromise the transmission of signals.

The document EP-A2-1492203 describes a socket according to the ISO standard 11783-2, comprising a body having an opening in which a contact-holder is inserted. The opening is closed with a cover articulated to the body. The socket comprises a yoke articulated to the body and movable between an open position and a closed position. The yoke is designed to engage a plug to hold it in an engaged position with the socket. A latch member is coupled to the yoke to lock the yoke in an engaged position.

The socket described in the document EP-A2-1492203 has the disadvantage that the cover is not locked in the closed position. Consequently, during cleaning operations of the socket to remove dirt deposits, the cover can lift up and open, allowing the infiltration of moisture into the socket and into the switching circuit. This particularly applies in the case of cleaning with high-pressure washing devices.

SUMMARY OF THE INVENTION

The present invention aims to provide a socket according to the ISO standard 11783-2, in which the cover in the closed position protects the opening for the insertion of the plug, and which also allows cleaning of the socket with high-pressure washing devices, in a reliable and safe manner, without moisture penetrating inside the electrical system.

According to the present invention, this object is achieved by a socket having the characteristics forming the subject of claim 1.

Preferred characteristics of the invention form the subject of the dependent claims.

The claims form an integral part of the disclosure provided in relation to the invention.

BRIEF DESCRIPTION OF THE DRAWINGS

The present invention will now be described in detail with reference to the accompanying drawings, given purely by way of non-limiting example, wherein.

DETAILED DESCRIPTION

Figure 1:
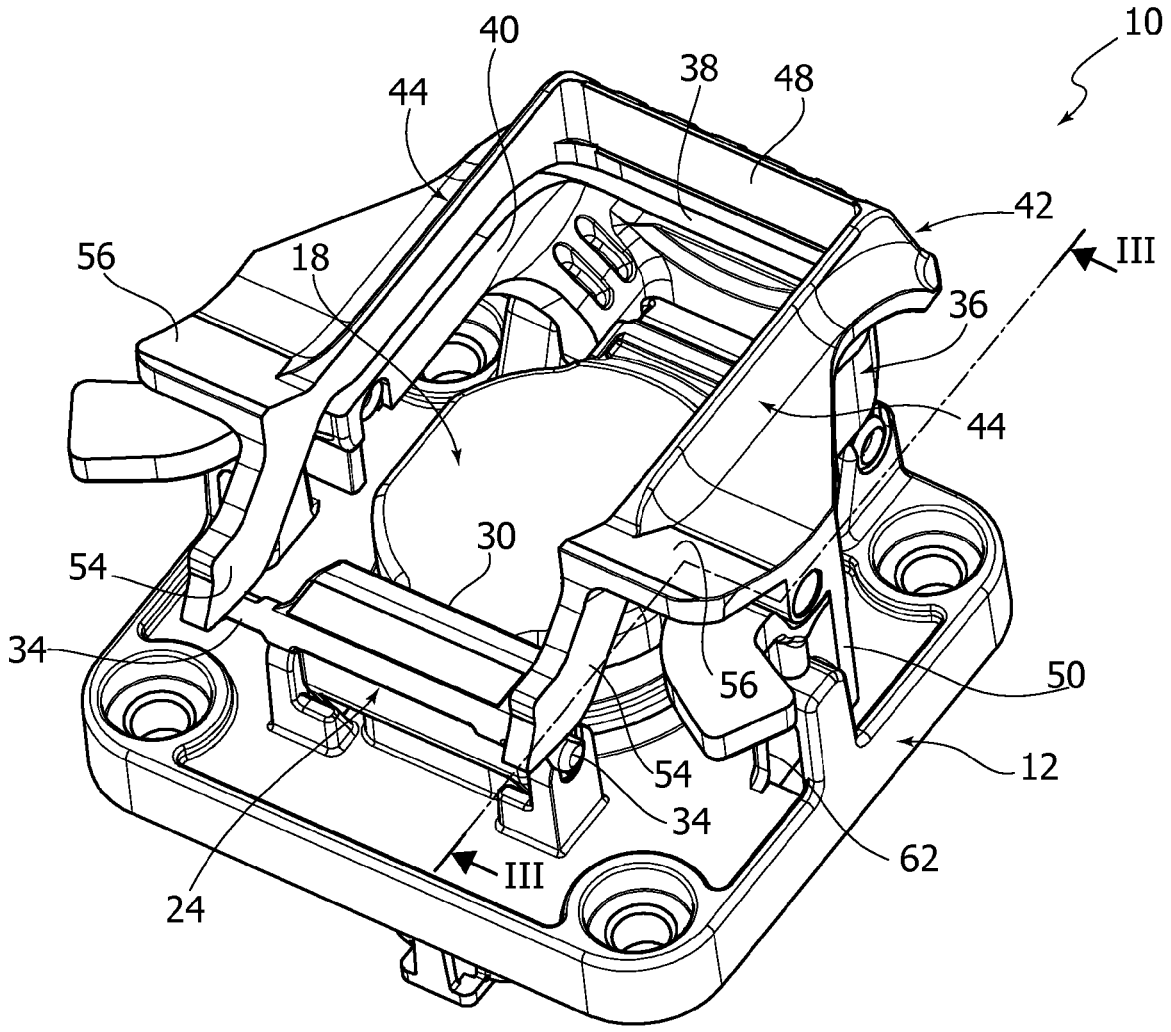
FIG. 1 is a perspective view of a socket according to the present invention in the closed position.
Figure 2:
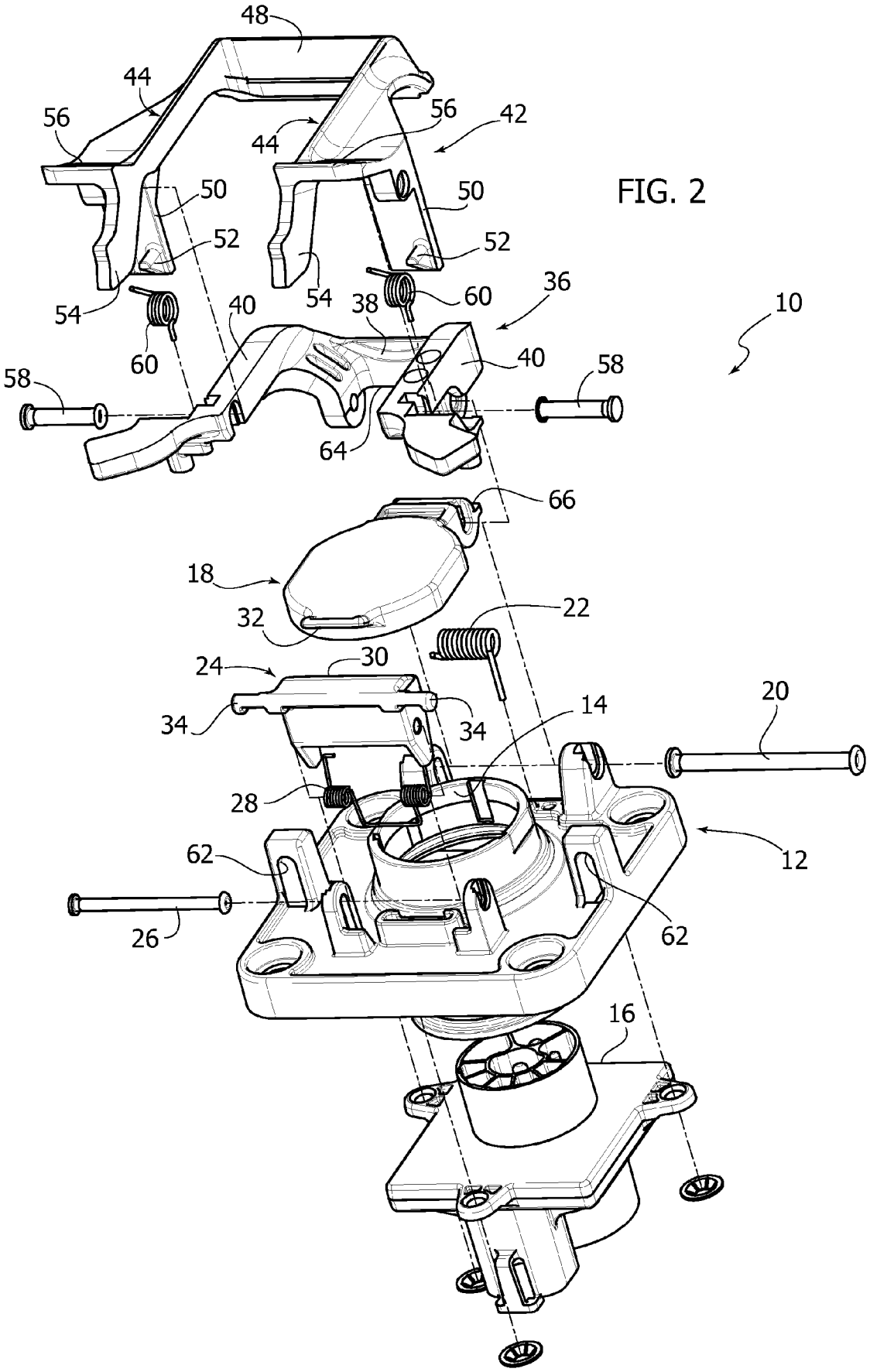
FIG. 2 is an exploded perspective view of the socket of FIG. 1.

With reference to FIGS. 1 and 2, numeral 10 indicates a socket intended to be mounted on a towing vehicle or on a tractor, and intended to be coupled to a plug mounted on a trailer or on an implement.

The socket 10 comprises a body 12 having an opening 14 in which a contact holder 16 is housed.

A cover 18 is articulated to the body 12 by a pin 20. The cover 18 is movable relative to the body 12 between a closed position in which it seals the open edge of the opening 14, and an open position in which it is raised from the opening 14. A spring 22 tends to elastically push the cover 18 into the closed position.

Figure 3:
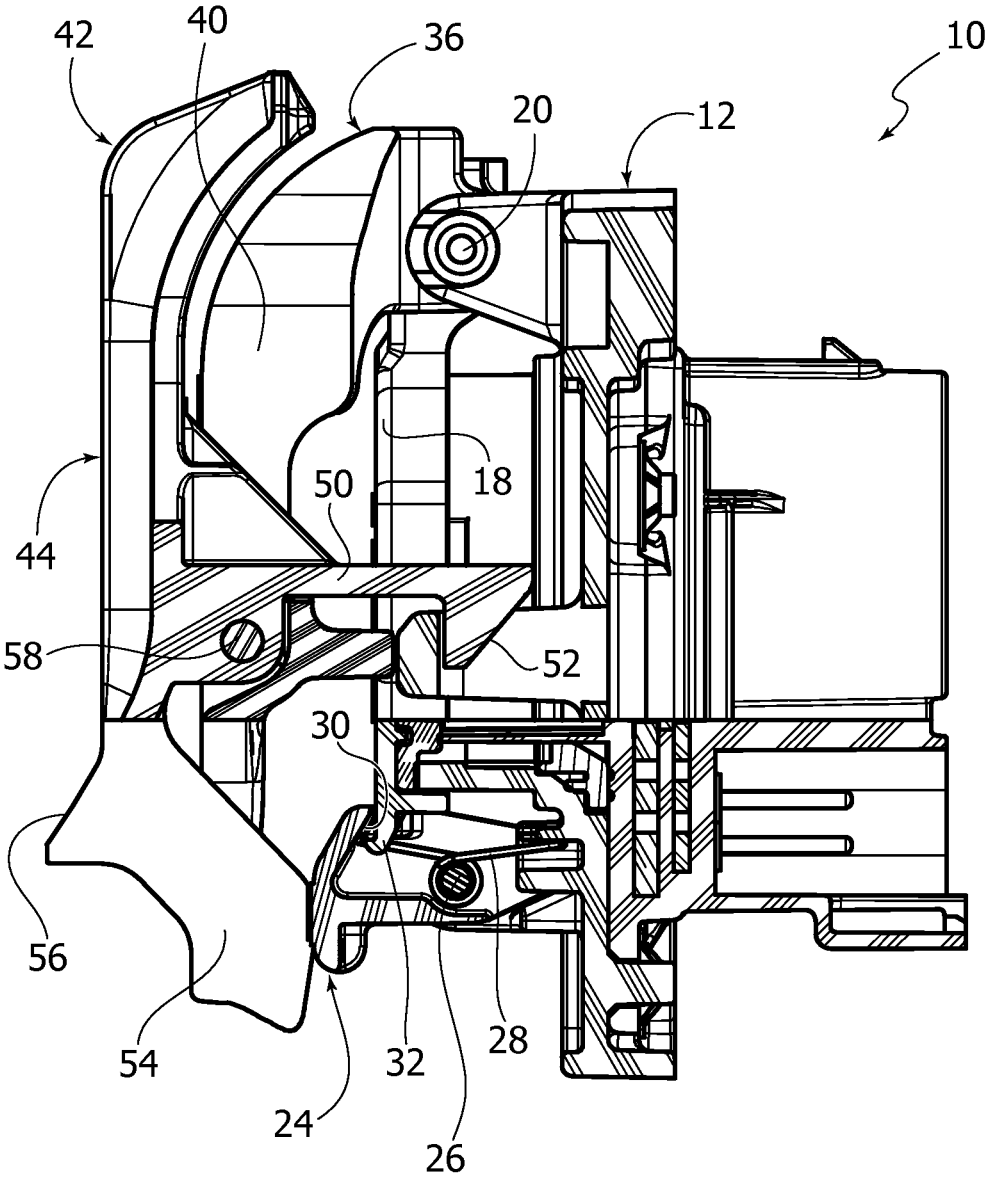
FIG. 3 is a section along the line III-III of FIG. 1.

The socket 10 comprises a cover-lock element 24, which is articulated to the body 12 by a pin 26. The cover-lock element 24 is movable relative to the body 12 between an engaged position and a disengaged position. A spring 28 tends to elastically push the cover-lock element 24 toward the engaged position. Preferably, the pin 26, around which the cover-lock element 24 is articulated, is parallel to pin 20, around which the cover 18 is articulated, and is located on the opposite side of the pin 20 with respect to the opening 14. With reference to FIG. 3, the cover-lock element 24 has a hook formation 30 that, in the engaged position, couples with a pawl 32 of the cover 18 and locks the cover 18 in the closed position. With reference to FIG. 2, the cover-lock element 24 has two lateral appendages 34 whose function will be outlined below.

The socket 10 comprises a yoke 36 articulated to the body 12 and movable between a lowered position and a raised position. Preferably, the yoke 36 is articulated to the body 12 around the same pin 20 around which the cover 18 is articulated. The yoke 36 has a central portion 38 from which two arms 40 extend.

The socket 10 also comprises a latch member 42 articulated to the yoke 36, and movable with respect to the yoke 36 between a locked position and an unlocked position. According to a preferred embodiment, the latch member 42 has two symmetrical levers 44 joined together by a transverse element 48. Each of the two levers 44 has an arm 50 having a pawl 52. Each of the two levers 44 has a respective cam portion 54 and a pressure zone 56. The latch member 42 is articulated to the yoke 36 by means of two pins 58 that extend along a common axis, parallel to the pin 20. Each pin 58 extends through aligned holes of the respective arm 40 of the yoke 36 and of the corresponding lever 44 of the latch member 42. Two springs 60 are arranged between the yoke 36 and the latch member 42, which tend to elastically push the latch member 42 toward the locked position.

FIG. 1 shows the socket 10 in a closed configuration. In this configuration, the cover 18 seals the edge of the opening 14 and is locked in the closed position by the cover-lock element 24. The yoke 36 is in the lowered position and the latch member 42 is in the locked position. In this position, the pawls 52 of the latch member 42 engage corresponding seats 62 of the body 12. The cam portions 54 of the latch member 42 are facing the lateral appendages 34 of the cover-lock element 24.

To open the cover 18, a pressure is applied manually on one of the two pressure zones 56 of the latch member 42. The latch member 42 has a symmetrical shape, with the two levers 44 and the two pressure zones 56 arranged on opposite sides of the cover 18, to allow operation either with the right hand or with the left hand as a function of the position in which the socket 10 is mounted on the vehicle.

Figure 4:
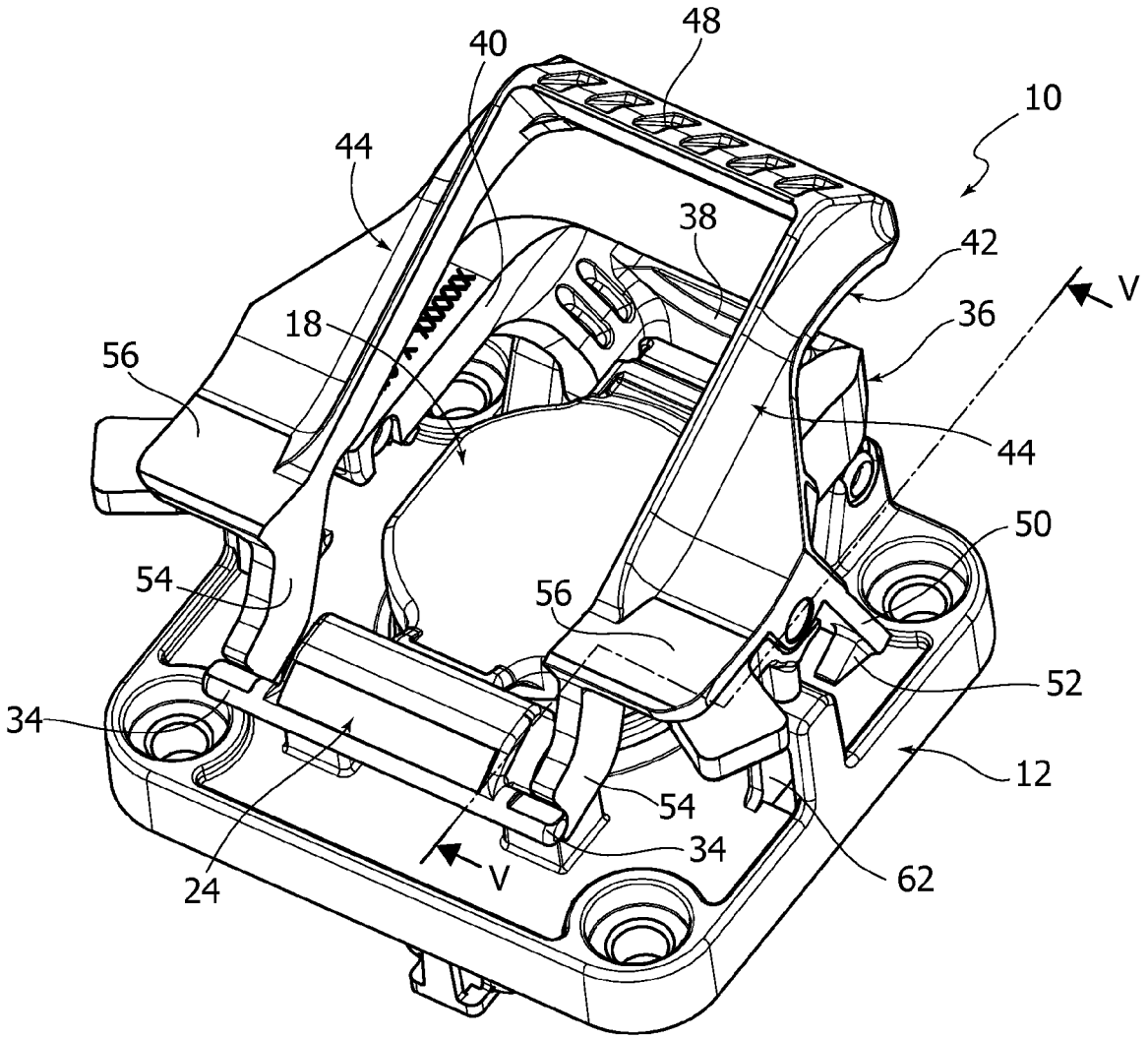
FIG. 4 is a perspective view illustrating the socket of FIG. 1 during the cover unlocking step.
Figure 5:
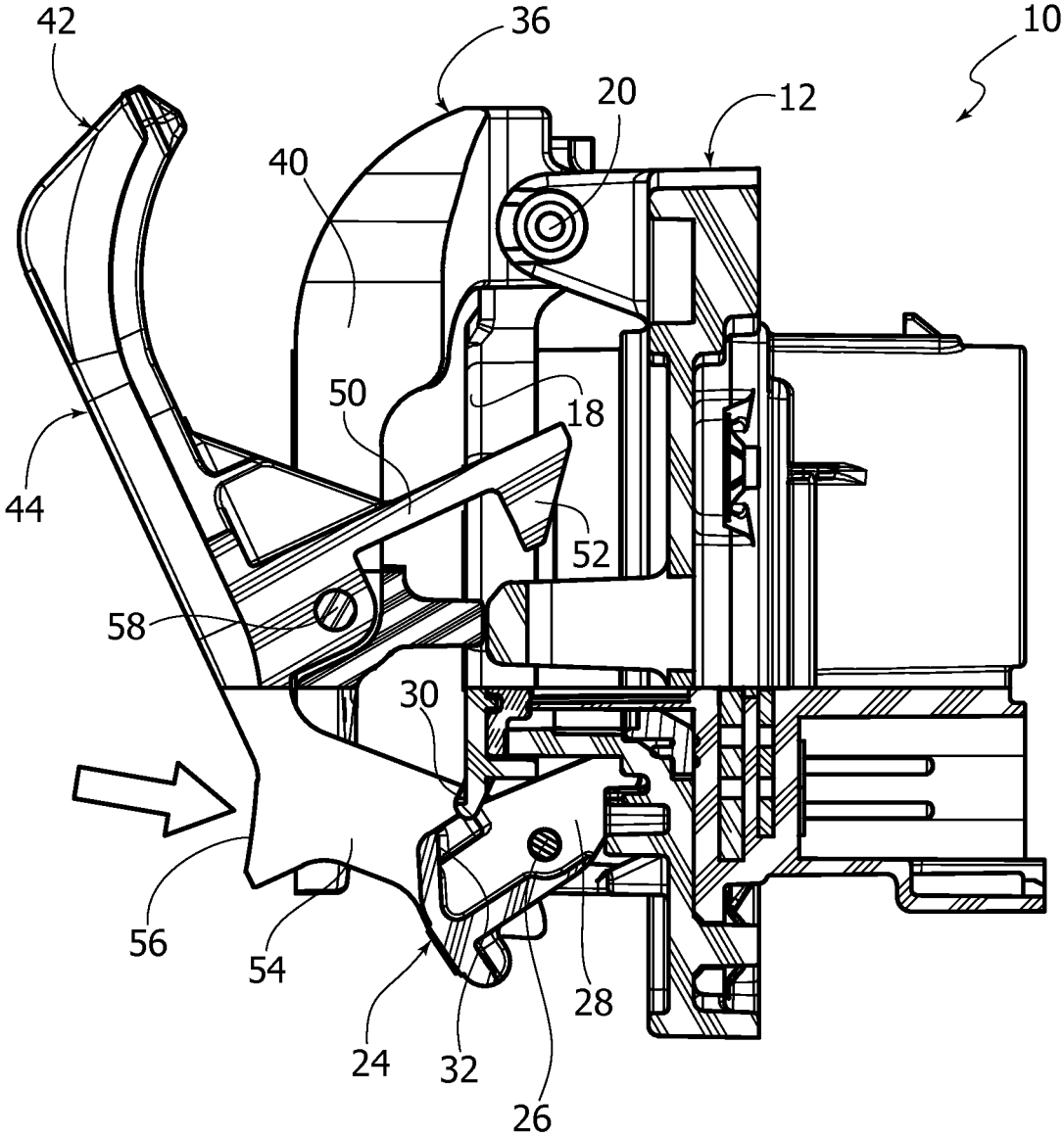
FIG. 5 is a section along the line V-V of FIG. 4.

With reference to FIGS. 4 and 5, by pressing on one of the pressure zones 56, the latch member 42 rotates relative to the yoke 36, moving it into the unlocked position illustrated in FIGS. 4 and 5. The movement of the latch member 42 from the locked position toward the unlocked position controls, by means of the cam portions 54 and the lateral appendages 34, the oscillation of the cover-lock element 24 from the engaged position toward the disengaged position.

After disengagement of the latch member 42 from the body 12, and the simultaneous disengagement of the cover-lock element 24 from the cover 18, the yoke 36 is rotated around the pin 20 toward the raised position. During the movement of the yoke 26 from the lowered position to the raised position, a lower surface 64 of the central portion 38 of the yoke 36 (FIG. 2) acts on a projection 66 of the cover 18 and makes the cover 18 oscillate toward the open position, against the action of the spring 22, which tends to push the cover 18 into the closed position.

Figure 6:
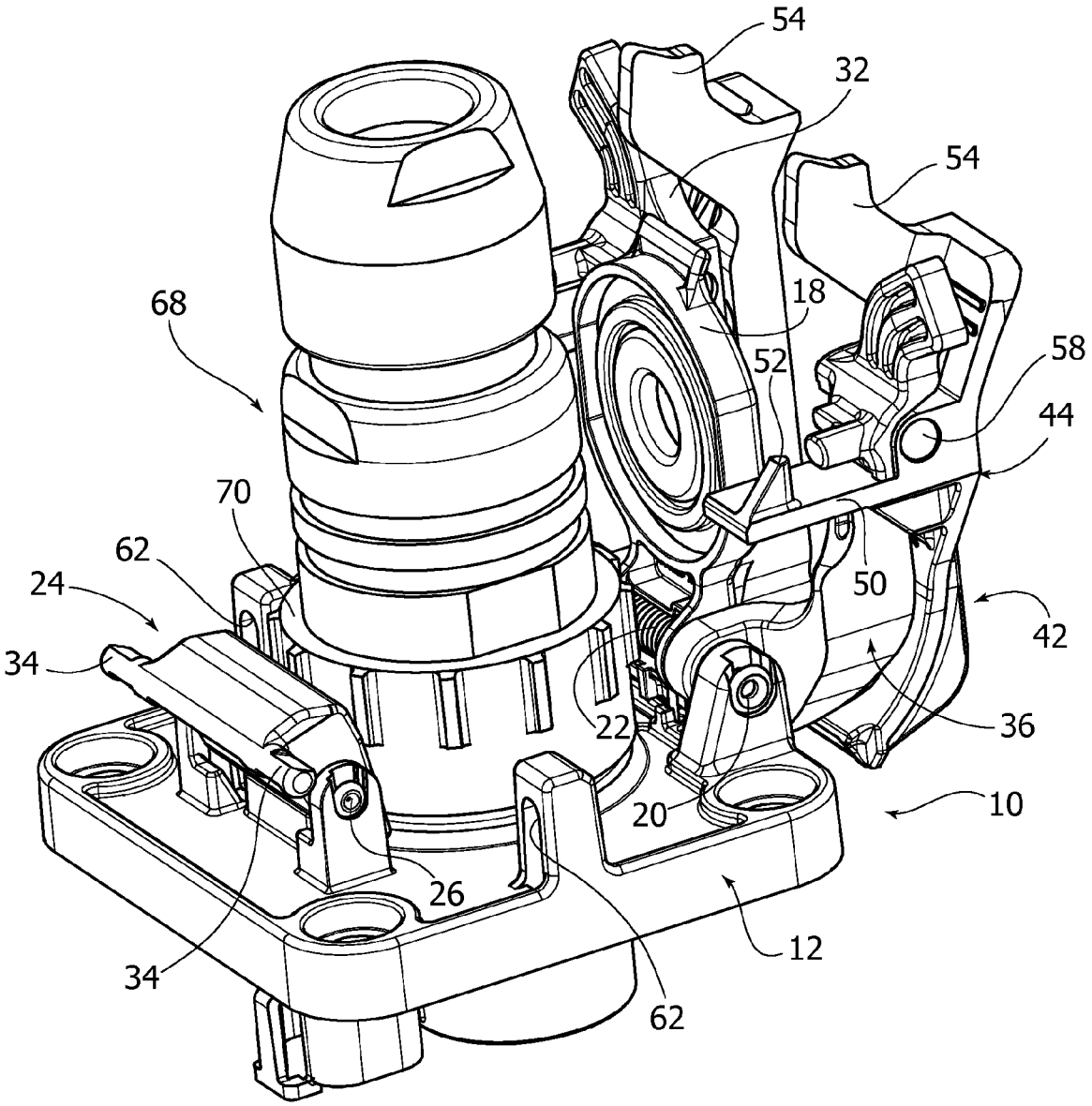
FIG. 6 is a perspective view illustrating the socket according to the invention coupled to a plug.

With reference to FIG. 6, with the yoke 36 in the raised position and the cover 18 in the open position, the socket 10 can receive a plug 68 into the opening 14. FIG. 6 illustrates the condition in which the plug 68 is inserted into the socket 10, and the yoke 36 is in the raised position.

After having inserted the plug 68 into the socket 10, the yoke 36 is rotated into the lowered position. The arms 40 of the yoke 36 rest on a shoulder 70 of the plug 68 and push the plug 68 into the fully-inserted position with the socket 10. The yoke 36 is locked in the lowered position by the latch member 42. As a matter of fact, when the yoke 36 is in the lowered position illustrated in FIG. 7, the springs 60 push the latch member 42 into the locked position in which the pawls 52 of the latch member 42 engage the seats 62 of the body 12.

Figure 7:
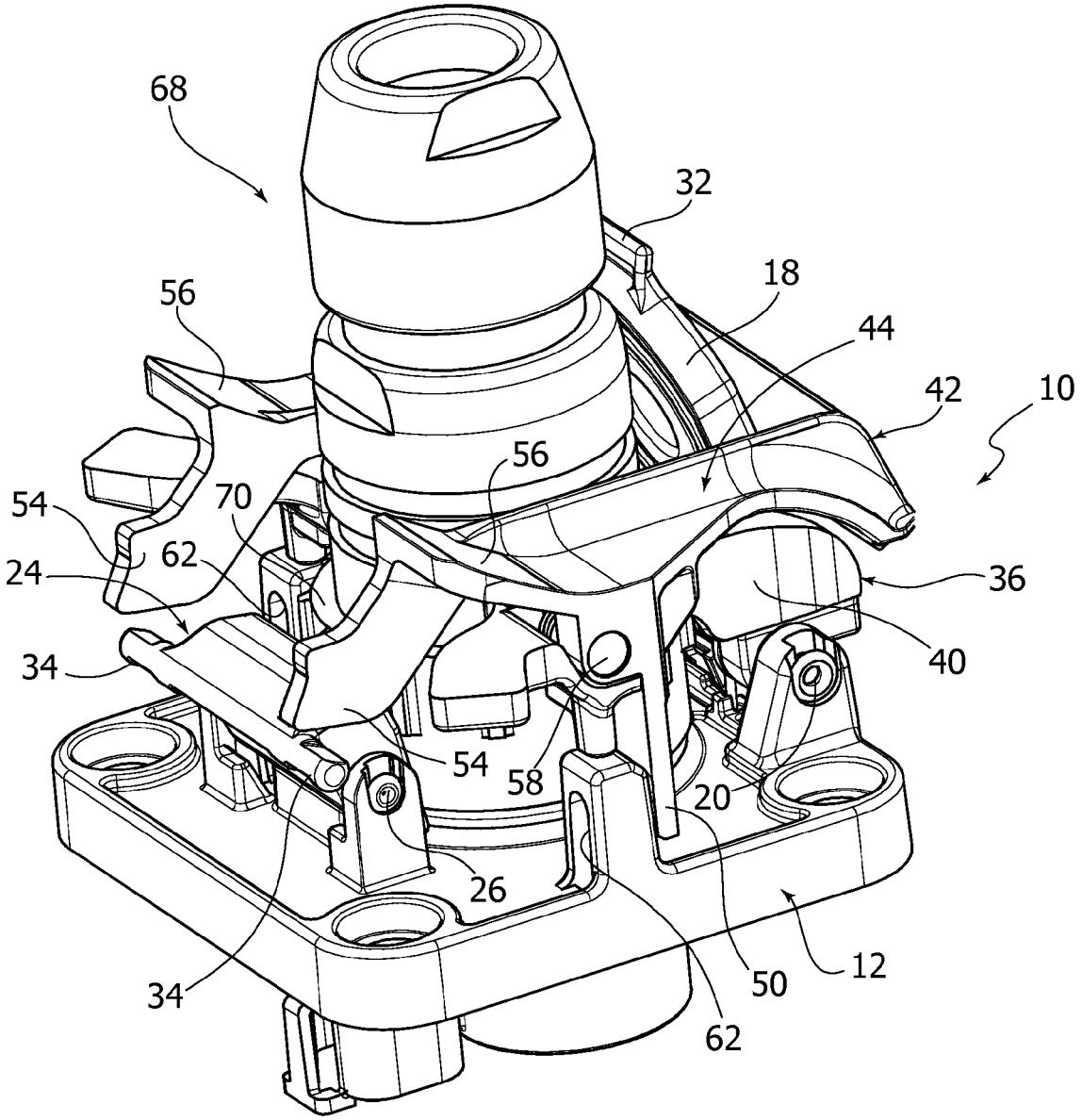
FIG. 7 is a perspective view illustrating the plug-socket assembly in the locked position.

In the position of FIG. 7, the plug 68 is locked in the inserted position with the socket 10. The pawls 52 of the latch member 42, and the corresponding seats 62 are shaped so that the latch member 42 does not disengage from body 12 when the plug 68 is subjected to a traction, which tends to pull it out from the socket 10. Locking of the plug 68 with respect to the socket 10 is carried out solely by the latch member 42. The cover-lock member 24 does not intervene to lock the plug 68.

To disconnect the plug 18, it is first necessary to unlock the latch member 42, acting on one of the pressure zones 56, and then rotating the yoke 36 into the raised position. At this point, it is possible to disconnect the plug 68 from the socket 10.

After disconnecting the plug 68, the springs rotate the cover 18 toward the closed position and, thanks to the contact between the projection 66 and the surface 64, the yoke 36 also rotates from the raised position to the lowered position. During the closing of the cover 18, the pawl 32 of the cover 18 automatically engages with the cover-lock element 24.

Locking the cover 18 in the closed position allows the reliable sealing of the opening 14 and prevents the opening of the cover, including the case in which high-pressure washing devices are used to remove dirt deposits from the socket 10. The cover-lock element 24 is automatically disengaged upon acting on the latch member 42 to unlock the yoke 36. Unlocking the latch member 42 can be carried out either by acting with the right hand alone or with the left hand alone, thanks to the symmetrical conformation of the latch member 42. This aspect is advantageous where the socket 10 is not installed in standardized positions, and it is important to ensure the accessibility of the unlocking zone of the latch member 42 regardless of the mounting position of the socket 10 on the vehicle.

Of course, without prejudice to the principle of the invention, the details of construction and the embodiments may vary widely with respect to those described and illustrated without departing from the scope of the invention as defined by the following claims.

The invention claimed is:

1. A socket comprising:

a body having an opening in which a contact-holder is housed, a cover articulated to the body and movable between a closed position in which it closes said opening and an open position in which it is raised from said opening, a yoke articulated to the body and movable between a lowered position and a raised position, the yoke having two arms which, in the lowered position, are intended to cooperate with a shoulder of a plug to retain the plug engaged with the socket, a latch member articulated to the yoke and movable relative to the yoke between a locked position and an unlocked position, the latch member having at least one pawl which, in the locked position, engages a corresponding seat of the body and which, in the unlocked position, is disengaged from said seat, a cover-lock element articulated to the body and movable between an engaged position and a disengaged position, wherein the cover-lock element, in the engaged position, couples with the cover and locks the cover in the closed position, wherein the latch member has at least one cam portion that cooperates with the cover-lock element for moving the cover-lock element from the engaged position to the disengaged position when the latch member moves from the locked position to the unlocked position.

2. A socket according to claim 1, wherein said latch member has two levers joined together by a transverse element, said levers having respective pressure zones, wherein said latch member rotates from the locked position to the unlocked position following a pressure on either one of said pressure zones.

3. A socket according to claim 2, wherein each of said levers has a respective cam portion, said cam portions cooperating with lateral appendages of said cover-lock element.

4. A socket according to claim 2, wherein each of said levers has a respective arm having a respective pawl.

5. A socket according to claim 1, wherein said cover-lock element is elastically pushed toward said engaged position.

6. A socket according to claim 1, wherein said cover-lock element is articulated to the body around a pin parallel to a pivot pin of the cover and located on an opposite side of said opening with respect to the pivot pin of the cover.

7. A socket according to claim 1, wherein the cover-lock element is in the disengaged position when the cover is in the open position.

* * * * *